United States Patent [19]

Stumpp

[11] 4,143,631

[45] Mar. 13, 1979

[54] APPARATUS FOR REGULATING THE COMPOSITION OF THE OPERATING MIXTURE OF AN INTERNAL COMBUSTION ENGINE

[75] Inventor: Gerhard Stumpp, Stuttgart, Fed. Rep. of Germany

[73] Assignee: Robert Bosch GmbH, Stuttgart, Fed. Rep. of Germany

[21] Appl. No.: 863,003

[22] Filed: Dec. 21, 1977

[30] Foreign Application Priority Data

Dec. 22, 1976 [DE] Fed. Rep. of Germany ..... 2658051

[51] Int. Cl.[2] ..... F02M 25/06; F02M 63/00; F02M 7/00

[52] U.S. Cl. ..... 123/119 A; 123/139 BG; 123/139 AW; 123/103 E

[58] Field of Search ..... 123/139 BG, 139 AW, 123/140 FG, 103 C, 103 E, 106, 119 A

[56] References Cited

U.S. PATENT DOCUMENTS

| | | | |
|---|---|---|---|
| 3,113,562 | 12/1963 | Henry-Biabaud | 123/140 FG |
| 4,015,571 | 4/1977 | Stumpp | 123/139 BG |
| 4,031,873 | 6/1977 | Banzhaf et al. | 123/139 BG |
| 4,043,304 | 8/1977 | Stumpp | 123/119 A |

*Primary Examiner*—Ronald B. Cox
*Assistant Examiner*—Andrew M. Dolinar
*Attorney, Agent, or Firm*—Edwin E. Greigg

[57] ABSTRACT

A regulating device used with the fuel injection system of an internal combustion engine, for regulating the proportions of the operating mixtures of the engine. The regulating device is embodied as a pump which is incorporated into the existing fuel injection system. The pump has a chamber within which a piston is displaceable. This piston is coupled with the fuel rate adjusting member of the fuel injection pump of the fuel injection system, and is displaced in accordance with the adjusted position of the fuel rate adjusting member. The pump is also connected with the throttle plate of the fuel injection system located in the induction tube of the engine. By reason of these connections, rapid adjustment movements of the fuel rate adjusting member can be effectively translated to a proper adjustment of the throttle plate without the delay found in presently known regulating devices.

3 Claims, 1 Drawing Figure

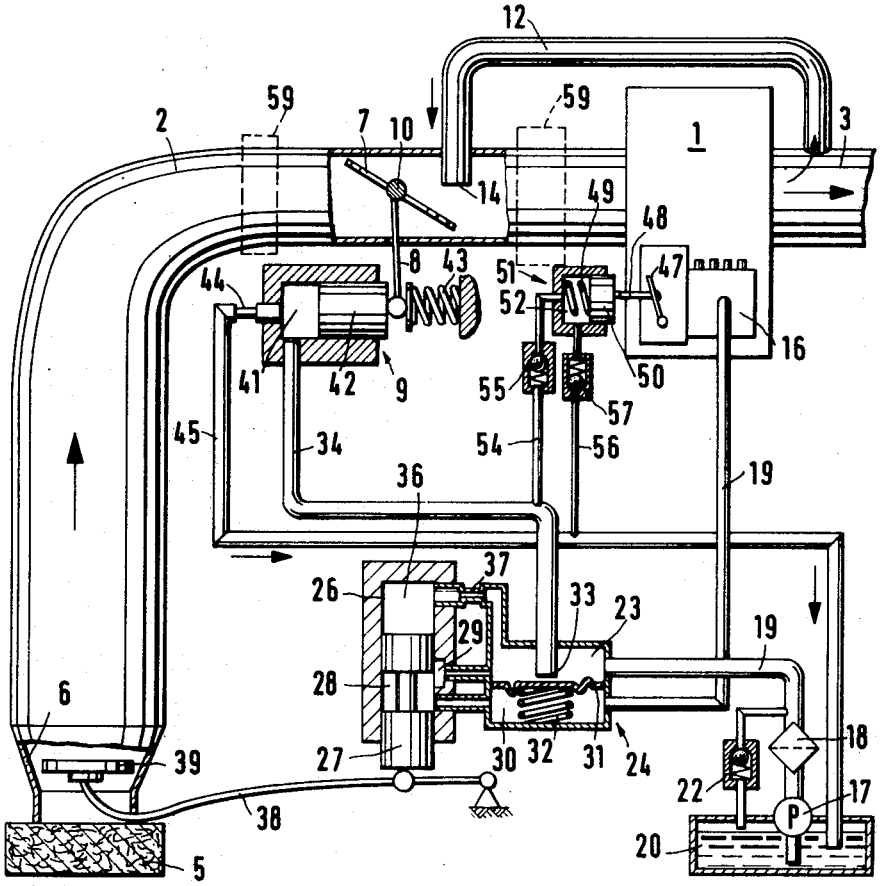
12
59
59
2
7
10
1
3
14
49
48
8
43
51
47
44
52
16
41
42
9
55
50
57
45
34
54
56
19
36
37
26
33
23
29
19
28
6
18
39
27
30
32
31
24
22
17
38
P
20
5

APPARATUS FOR REGULATING THE COMPOSITION OF THE OPERATING MIXTURE OF AN INTERNAL COMBUSTION ENGINE

BACKGROUND OF THE INVENTION

The invention relates to a regulating device, and in particular to a device for regulating the proportions of the operating mixture of an internal combustion engine. The regulating device is part of a fuel metering device with a fuel supply line having a throttle member arranged therein. The throttle member can be activated, in accordance with the air flow drawn into the induction tube, by means of an air flow rate meter of the internal combustion engine. The throttle member has a metering cross section, and downstream of the metering cross section lies an uncontrolled pressure chamber of a differential pressure valve. The differential pressure valve also has a controlled pressure chamber lying upstream of the metering cross section. A pressure relief line provided with a throttled end leads from the controlled pressure chamber. The pressure relief line is connected with the operating chamber of a servo-motor upstream from the throttle, which servo-motor is connected with a throttle plate arranged in the induction tube downstream of the air flow rate meter.

This type of regulating device has the disadvantage, however, in that during very rapid adjustment movements of the fuel rate adjusting member of the fuel metering device the following regulating process by the differential pressure valve, and the thus controlled servo-motor for adjustment of the throttle plate, cannot be completed fast enough, so that there is a temporary over-enrichment of the operating mixture and a surge of exhaust smoke during acceleration. This is especially true when the fuel supply pump has only a limited supply performance capability, so that the necessary fuel rate for the adjustment of the servo-motor is not available soon enough.

OBJECT AND SUMMARY OF THE INVENTION

The principal object of the present invention is to provide a regulating device in which the above-noted disadvantage is overcome.

This object is achieved by a regulating device is part of a fuel metering device with an arbitrarily adjustable fuel injection rate and a throttle plate arranged in the induction tube, which can be activated by a servo-motor for a complementary adjustment of the induction tube cross section and the cross section of an exhaust gas return line. The servo-motor is activated in accordance with a deviation of a fuel rate that is metered in a definite ratio to the intake fresh air rate by the fuel rate actually supplied from the fuel metering device of the internal combustion engine, and thereby regulates the necessary fresh air induction rate to achieve an operating mixture of a specific composition. In order that a rapid following of the air rate and the exhaust gas return rate can be accomplished during a rapid arbitrary increase of the fuel injection rate, a pump is connected with the fuel rate adjusting member of the fuel metering device, which pump conveys fuel into the operating chamber of the servo-motor when the fuel rate adjusting member is activated in the direction of an increased fuel rate. In this manner the throttle plate experiences a momentary unregulated activation, thus avoiding an immediate over-enrichment of the operating mixture during acceleration, and an associated surge of exhaust smoke.

The novel device with the distinguishing characteristics of the claims has the advantage, in contrast to the known regulating devices, that a quantity of fuel stored during an operating interval of the servo-motor by the adjusting movement of the fuel rate adjusting member during acceleration is available for an immediate unregulated adjustment of the throttle plate by the servo-motor. After the adjusting process has ended, a pressure neutralization can take place by means of the throttle in the pressure relief line that corresponds to the value set by the fuel flow to the operating chamber of the servo-motor as regulated by the differential pressure valve. In an advantageous manner, the adjusting member of the pump chamber that is uncoupled from the servo-motor by the check valve, follows every adjusting movement of the fuel rate adjusting member, in that during an adjustment in the direction of a lesser fuel injection rate, a corresponding amount of fuel is brought into the pump chamber by means of the suction line. The novel device allows the throttle plate to be temporarily adjusted independently of the fuel supply capacity of the fuel supply pump and independently of the regulating characteristics of the differential pressure valve, so that during a sudden and arbitrary increase in the fuel supply rate sufficient fresh air can be fed-in to reliably avoid an over-enrichment of the operating mixture while maintaining a slow and thereby stable regulation of the exhaust gas return rate in different operating ranges of the internal combustion engine.

BRIEF DESCRIPTION OF THE DRAWING

The sole FIGURE illustrates partly in cross section, an exemplary embodiment of the invention which is described in greater detail in the following description.

DESCRIPTION OF THE PREFERRED EMBODIMENT

A simplified internal combustion engine 1 is shown in the exemplary embodiment having an air induction tube 2 and an exhaust gas manifold 3. At its inlet, the induction tube 2 is provided with an air filter 5. Immediately downstream of the inlet, in the direction of air flow, the induction tube is widened to a venturi section 6 leading to the internal combustion engine. Downstream of the venturi section 6 in the induction tube, a throttle plate 7 is pivotably mounted by a shaft 10. The throttle plate 7 is connected by means of a rod 8 with a servo-motor 9. Downstream of the shaft 10 an exhaust gas return line 12 joins the induction tube 2 with the exhaust gas manifold 3. The exhaust gas return line 12 has an overflow opening 14 lying in the center of the induction tube 2 in the area of the induction tube 2 where that half of the throttle plate 7 that is downstream of the shaft 10 rotates. The opening 14 is closed by the noted throttle plate half, when the throttle plate is fully opened.

The internal combustion engine is supplied with fuel in a known manner by means of a fuel injection pump 16. This may involve either a known series injection pump, such as that shown in the exemplary embodiment, or a distributor-type injection pump, or a suction throttle injection pump. The injection pump is supplied with fuel from a fuel tank 20 by a fuel supply pump 17 and a fuel supply line 19. The fuel supply pump 17 is located directly behind a fuel filter 18 and a pressure regulating valve 22. The pressure regulating valve 22 is parallel to the fuel supply pump 17 and fuel filter 18, and controls a discharge line to the fuel tank 20. By means of the pressure regulating valve 22 a desired, essentially constant fuel supply pressure can be attained, which, in addition, can be influenced according to chosen operating parameters, such as air pressure or temperature.

The fuel supply line 19 leads through a controlled pressure chamber 23 of a differential pressure valve 24 to a guide bore 26 of a slide valve 27, that serves as a throttle member in the fuel supply line. The slide valve 27 is provided with an annular groove 28, and, depending on the position of the slide valve 27, the limiting edge of the annular groove 28 opens, to a greater or lesser extent, a metering cross section 29, or throughput cross section in the fuel supply line 19. Downstream of the metering cross section, the fuel supply line 19 is open and leads from the annular groove 28 and through an uncontrolled pressure chamber 30 of the differential pressure valve 24 to the fuel injection pump 16. The uncontrolled pressure chamber 30 is separated from the controlled pressure chamber 23 by a diaphragm 31. A pressure spring 32 is arranged in the chamber 30. By means of the spring characteristics and tension of the spring 32, the differential pressure, which can be adjusted by the differential pressure valve, is essentially determined. The diaphragm 31, together with the opening 33 of a pressure relief line 34, leading from the controlled pressure chamber 23, forms a valve, through which more or less fuel can flow, depending on the displacement of the diaphragm.

The pressure chamber 36, partly defined by the slide valve 27 in the guide bore 26, which is formed as a blind bore, is in continual connection with the fuel supply line 19 upstream of the metering cross section 29 by means of a stationary throttle 37. In this manner the regulated, essentially constant fuel pressure of the supply line 19, upstream of the metering cross section 29, acts upon the slide valve 27. By means of this pressure the slide valve 27 is pressed against a rotating arm 38. The arm 38 is mounted at one end as a friction arm, and at its other end, that projects into the area of the venturi section 6, has a baffle plate 39 attached thereto. The baffle plate 39 is displaced by the impact pressure of the air flow, that is by the pressure difference acting thereon against the basically constant force produced by the fuel pressure transferred thereto by the slide valve 27. With the aid of the profile of the venturi section 6, it can be achieved, that for a continuing enlargement of the open annular area between the baffle plate 39 and the wall of the venturi section, varying adjusting paths of the baffle plate 39 are needed for a constant pressure differential. It can also be achieved, for example with a slot-shaped embodiment of the metering cross section 29, that the metering cross section changes linearly with the adjusting path of the slide valve 27, which is activated according to the displacement of the baffle plate 39. By means of the profile of the venturi section 6 under a constant return force and constant differential pressure at the metering cross section 29, a suitable, desirable ratio of fuel to air can be adjusted, even for different operational ranges.

The pressure relief line 34 leads into an operating chamber 41 of the servo-motor 9. The servo-motor 9 has an adjusting member 42 formed here, for example, as an operating piston. The adjusting member 42 is acted upon, against the hydraulic adjusting pressure in the chamber 41, by a pressure spring 43. The adjusting member 42, which can also be formed, for example, as a diaphragm, is coupled with the rod 8 to adjust the throttle plate 7. The operating chamber 41 is, in addition, connected with the fuel tank 20 by means of a stationary throttle 44 and a return line 45.

The fuel injection pump 16 includes, in a known manner, a fuel rate adjusting member (not shown). The fuel rate adjusting member is arbitrarily adjustable by means of a lever 47. This lever can, for example, be connected with the gas pedal of the motor vehicle. A transfer member 48 is connected with the lever 47, against which the outside wall of an adjusting member 50, of a pump 51, is pressed in an adjusting direction of the lever 47 to decrease the fuel rate by the force of a pressure spring 49. The adjusting member 50 follows all movements of the lever 47.

The adjusting member 50, which in this case is a piston tightly guided in a bore, closes a pump chamber 52 in the pump 51, from which a pressure line 54 leads to the pressure relief line 34 or directly into the operating chamber 41 of the servo-motor 9. A check valve 55, that opens in the supply direction to the operating chamber 41, is arranged in the pressure line 54, which check valve 55 uncouples the pump chamber 52 from the control system for the throttle plate 7. In addition, a suction line 56 leads to the pump chamber 52, in which suction line 56 a check valve 57 is arranged that also opens in the suction direction. The suction line 56 is connected either to the return line 45 or directly to the fuel tank 20.

The above described device operates in the following manner: When the lever 47, beginning from a stationary operating condition of the internal combustion engine, moves the fuel rate adjusting member of the injection pump 16 in the direction which increases the fuel rate, then more fuel will accordingly be fed through the fuel supply line of the injection pump. In the resulting position of the slide valve 27, which is at first constant, however, this leads to a pressure drop in the uncontrolled pressure chamber 30 of the differential pressure valve. This pressure drop causes an adjustment of the diaphragm 31 and thereby an enlargement of the opening 33 of the pressure relief line 34. By means of the increased fuel outflow rate, the pressure in the operating chamber 41 is increased under the influence of the stationary throttle 44, so that the adjusting member 42 moves against the force of the spring 43 and the throttle plate 7 is moved in the opening direction. This leads to an increase of the supplied fresh air rate with a simultaneous decrease of the feedback exhaust gas rate. This results because, by means of the enlarged induction tube throughput cross section at the throttle plate 7, the suction pressure produced by the internal combustion engine has a stronger effect on the baffle plate 39. Because of this stronger effect, the baffle plate 39 is displaced under the influence of the temporarily increased pressure differential, until a force neutralization again prevails at the rotating arm 38. During a displacement of the lever 47 in the opposite direction, the above described process takes plate in reverse. By means of this device one obtains an extremely precise association of the fuel rate fed to the internal combustion engine to the intaken fresh air rate, and in addition, there is the possibility of supplying exhaust gas return rates in optimal doses to the internal combustion engine, without lowering its performance, for example, during full load operation. In this case the fully opened throttle plate 7 completely closes the exhaust gas return line 12.

A further advantage of the device is that the fuel feed rate and the fuel metering take place outside of the fuel injection pump 16, which is subject to many influences that could cause error. Yet the possibility still remains, for example, to arbitrarily carry out a rapid and large adjustment of the fuel feed rate by adjusting the lever 47 in order to accelerate.

By means of the described device, a continually and oscillation free control of the fresh air intake rate is achieved, following an adjustment of the fuel feed rate. The adjustment of the throttle plate 7 takes place accordingly relatively slowly. This slow adjustment is a disadvantage, for rapid changes in the fuel injection rate and during borderline ratios on the smoke limit, leading to an over-enrichment of the operating mixture, because the throttle plate 7 cannot follow this adjustment fast enough. By means of the novel embodiment of the pump 51, however, it is now guaranteed, that during a rapid adjustment of the lever 47, fuel is supplied directly into the operating chamber 41 corresponding to the displacement of the lever 47, and the throttle plate 7 is simultaneously opened. As soon as these adjusting motions have been carried out, a pressure neutralization takes place by means of the throttle 44, so that the pressure regulated in the operating chamber 41 by the differential pressure valve 24 is again established and the position of the throttle plate 7 following accordingly.

If the lever 47 is adjusted in the direction of a decreased fuel feed rate, then the piston 50 following the adjusting lever under the influence of the spring 49 and draws in fuel according to the volume enlargement of the pump chamber 52. In this case there is no reaction on the servo-motor 9, from which the pump 51 is uncoupled by the check valve 55.

Naturally the spring 49 of the pump 51 can also be discarded when piston 50 is rigidly connected with the fuel rate adjusting member or the lever 47 or some corresponding transfer member, and the fuel rate adjusting member is acted upon by a known spring acting in the stop direction, the spring being already present in the injection pump.

The control of the exit opening 14 of the exhaust gas return line 12 is also not restricted to the illustrated embodiment. It can also be provided in an equivalent manner as an additional throttle member of the exhaust gas return line cross section controlled directly or indirectly by the servo-motor.

As is indicated by the rectangle 59, shown in the drawing by the dashed lines, a supercharger (blower, compressor) can be provided on the suction side of the internal combustion engine in this embodiment of a regulating device for the operating mixture of the internal combustion engine without influencing the regulating result. The supercharger 59 can be arranged either downstream of the exhaust gas return line or upstream of the throttle plate 7 in the induction tube 2.

The foregoing relates to a preferred examplary embodiment of the invention, it being understood that other embodiments and variants thereof are possible within the spirit and scope of the invention, the latter being defined by the appended claims.

What is claimed is:

1. In a fuel injection system of an internal combustion engine, comprising: a fuel reservoir; a fuel injection pump having a fuel rate adjusting member; a fuel supply pump; a fuel supply line connected to the fuel supply pump, and the fuel injection pump through which fuel is delivered by the fuel supply pump to the fuel injection pump; a throttle member; an air flow rate meter connected to the throttle member, said throttle member being actuated by the air flow rate meter according to the inlet air flow drawn into the engine, said throttle member being connected also to the fuel supply line and defining a fuel metering cross section; a differential pressure valve connected to the fuel supply line and the throttle member, said differential pressure valve having a controlled pressure chamber and an uncontrolled pressure chamber, located respectively upstream and downstream of the metering cross section; a throttle plate mounted in the induction tube of the engine downstream of the air flow rate meter; a servo-motor having an adjusting member connected to the throttle plate and defining an operating chamber; a pressure relief line having a throttled end, said pressure relief line having its throttled end connected with the controlled chamber of the pressure differential valve and its other end connected with the operating chamber of the servo-motor; and a device for regulating the composition of the operating mixture of the engine, the improvement in said regulating device, comprising:

- a pump defining a pump chamber within which a piston is displaceable;
- a suction line connected to the pump chamber and the fuel reservoir;
- a check valve positioned in the suction line, and closing in the direction of the fuel reservoir;
- a pressure line connected to the pump chamber and the operating chamber of the servo-motor; and
- a check valve positioned in the pressure line and closing in the direction of the pump chamber, said pump piston being coupled with the fuel rate adjusting member of the fuel injection pump.

2. In the improved fuel injection system as defined in claim 1, wherein the regulating device further comprises:

- a return spring located in the pump chamber for biasing the pump piston in a direction tending to increase the volume of the pump chamber, and the fuel rate adjusting member in the decreasing fuel rate direction.

3. In the improved fuel injection system as defined in claim 1, further comprising: an exhaust gas return line connected to the induction tube downstream of the throttle plate in proximity to the throttle plate so that the cross section of the exhaust gas return line can be complementarily changed by the throttle plate along with the cross section of the induction tube.

* * * * *